US006929116B2

(12) United States Patent
Chao et al.

(10) Patent No.: US 6,929,116 B2
(45) Date of Patent: Aug. 16, 2005

(54) VISUAL DISPLAY OF CONTAINER CONTENTS

(75) Inventors: David Chao, Los Altos, CA (US); Yeou-Soon Lee, Chiayi (TW)

(73) Assignee: Contour Optik, Inc., Chiayi (CN)

( * ) Notice: Subject to any disclaimer, the term of this patent is extended or adjusted under 35 U.S.C. 154(b) by 258 days.

(21) Appl. No.: 10/127,331

(22) Filed: Apr. 22, 2002

(65) Prior Publication Data

US 2004/0211681 A1 Oct. 28, 2004

(51) Int. Cl.[7] ..... A45C 11/04; A47F 7/02

(52) U.S. Cl. ..... 206/5; 211/85.1

(58) Field of Search ..... 206/5, 316.1, 37, 206/38, 37.1, 39, 371, 822; D3/263, 265; 351/155, 158; 220/796–798, 377, 662; 211/128.1, 153, 71.01, 85.1, 69.1; D19/77, 81, 84, 85; D6/455, 459, 460, 473, 474

(56) References Cited

U.S. PATENT DOCUMENTS 1,092,156 A * 4/1914 Mathis ..... 211/69.1
2,606,708 A * 8/1952 Irvan ..... 220/796
D208,469 S * 9/1967 Parker ..... D6/474
3,593,856 A * 7/1971 Zander ..... 211/69.5
3,857,482 A * 12/1974 Shelton ..... 206/5
3,866,800 A * 2/1975 Schmitt ..... 222/94
4,572,366 A * 2/1986 Carson ..... 206/306
4,744,461 A * 5/1988 Lapham ..... 206/5
5,141,117 A * 8/1992 Olsen et al. ..... 211/71.01
5,949,515 A * 9/1999 Hoshino ..... 351/158
6,382,407 B1 * 5/2002 Chao ..... 206/5
6,491,158 B2 * 12/2002 Chen ..... 206/5
2003/0111361 A1 * 6/2003 Fischer et al. ..... 206/63.5

* cited by examiner

*Primary Examiner*—Mickey Yu
*Assistant Examiner*—J. Gregory Pickett
(74) *Attorney, Agent, or Firm*—Greenberg Traurig, LLP

(57) ABSTRACT

The present invention is directed to the visual display of the contents of eyeglass containers, which otherwise would not be visible to a person who observed the container.

5 Claims, 3 Drawing Sheets

VISUAL DISPLAY OF CONTAINER CONTENTS

FIELD OF THE INVENTION

The present invention is directed to the visual display of the contents of eyeglass containers, which otherwise would not be visible to a person who observed the container.

BACKGROUND OF THE INVENTION

Eyeglasses are stored in containers and eyeglass cases that are made of materials that are not transparent. Therefore, a person observing the case cannot see the glasses inside the case, if they are in fact in the case. Likewise, the observer cannot observe if the glasses are missing from the case.

With respect to some designs of eyeglass cases, the lack of transparency may not be a problem, because the shape and design of the case is such that, at the least, it suggests that the case holds a pair of eyeglasses. However, even if the design and shape suggests that the case is intended to hold eyeglasses, the lack of transparency does not allow a person to observe whether the glasses are present or not.

However, there is an aesthetic aspect to design that triumphs any or all of originality, innovation, ingenuity and creativity. Products that manifest that aesthetic may not bear any resemblance to the shape previously associated with that object. In view of this, it is possible that newly designed eyeglass cases may not, upon observation, suggest what they might contain. Accordingly, the observer of the container may not realize that the container is intended to contain eyeglasses, or that it in fact contained eyeglasses.

SUMMARY OF THE INVENTION

The present invention is an effort to improve upon the aforenoted deficiencies in the prior art of eyeglass cases by providing arrangements in which the contents of the cases can be observed. In one embodiment the invention is an eyeglass case provided with at least one region of transparency, which provides a window through which the interior of the case may be observed. In another embodiment the invention is directed to an eyeglass case separable into a first portion and a second portion, wherein the second portion has a tapered end, over which the opening in the first portion can be fitted. In this arrangement, when the eyeglasses are positioned in the second portion, a portion of the eyeglasses extends out of the second portion and is visible to the observer. In yet another embodiment, the invention includes a display case for displaying the embodiments previously described.

DETAILED DESCRIPTION OF THE PREFERRED EMBODIMENT

Figure 1:
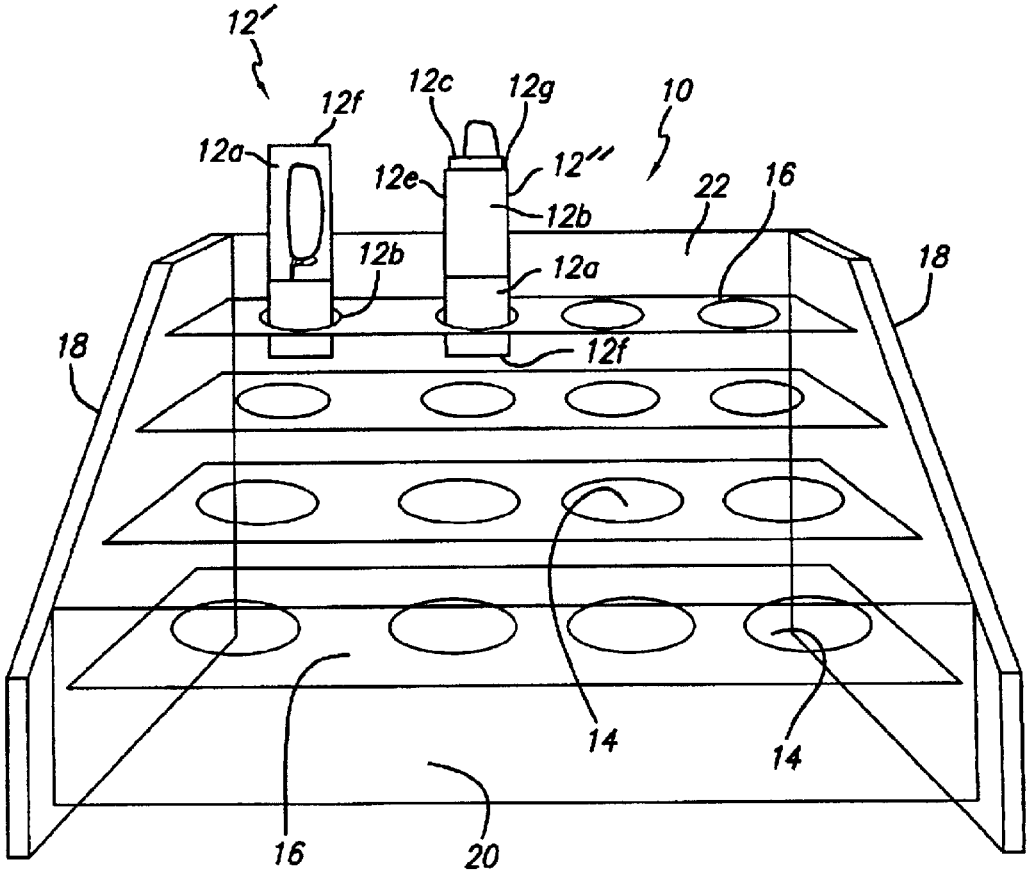
FIG. 1 is a perspective view of the embodiments of the present invention shown in a display case.

FIG. 1 shows an eyeglass case display 10 for holding a number of eyeglass cases 12, shown as 12' and 12". To allow for display of the contents of the cases 12, the case is provided with a plurality of openings 14 that are present in shelves 16. The shelves 16 are joined to sidewalls 18 of the display case. The case may also have a front wall 20 and a rear wall 22. The previously described components of the display case may be constructed of any suitable material, such as plastic, metal wood, or acceptable combinations thereof. Other materials may be used to construct the display case.

Eyeglass cases 12' and 12" are provided with first and second portions 12*a* and 12*b*, each of which have sidewalls 12*e* and end walls 12*f* that define a hollow interior 12*g* for holding and retaining a pair of eyeglasses. The second portion 12*b* is provided with skirt 12*c* having perimeter slightly smaller than the inner perimeter of first portion 12*a*. Thus when the first and second portion are joined together, they are maintained in that state by the frictional engagement between the skirt 12*c* and inner wall of the first portion 12*a*.

As shown for the two cases 12' and 12" displayed in FIG. 1, when case 12' is inserted into the opening 14 on the shelf, a portion of the second portion 12*b* resides below the shelf, and a portion 12*b* resides above the shelf, and, with regard to the other case 12", a portion of the first portion 12*a* resides below the shelf, and a portion of the first portion 12*a* resides above the shelf. This arrangement can be effected by tapering the cross sectional area of the first and second portions of the cases in the vicinity of the end walls 12*f*. That is, as the distance from the end 12*f* of the first portion 12*a* towards the middle/opening and the end 12*f* of the second portion 12*b* towards the middle/opening is traversed, the cross sectional area increases. As the cross sectional area of the first portion and second portion increases, the size of the cross sectional area at least becomes equal to the cross sectional area of the opening 14 in the shelf 16. The cross sectional area may continue to increase and then become constant or it may become constant at the point of equality. At most, the cross sectional area of the portion need only be slightly greater than the cross sectional area of the opening.

One way in which to allow an observer to view the contents of the eyeglass case is to display the eyeglass case in the open state, with the second portion 12*b* of the eyeglass case situated within the first portion 12*a*, as shown for case 12". The end of the first portion 12*a* is positioned in one of the openings 14 in the shelf 16. The eyeglasses are positioned in the second portion 12*b* and extend out of the second portion.

Figure 2:
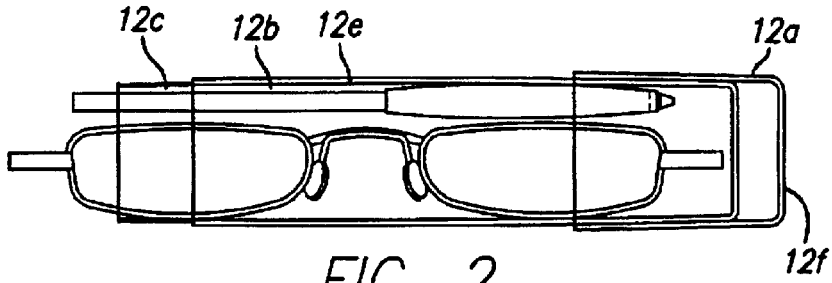
FIG. 2 is a side elevational view of an embodiment of an eyeglass case of the present invention.
Figure 4:
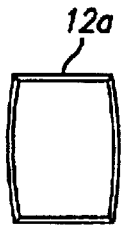
FIG. 4 is a front view of a cap of the embodiment of FIG. 3.
Figure 3:
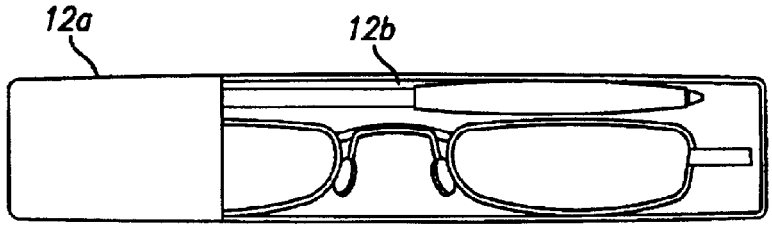
FIG. 3 is a side elevational view of another embodiment of an eyeglass case of the present invention.
Figure 6:
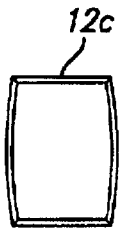
FIG. 6 is a front view of a cap of the embodiment of FIG. 5.
Figure 5:
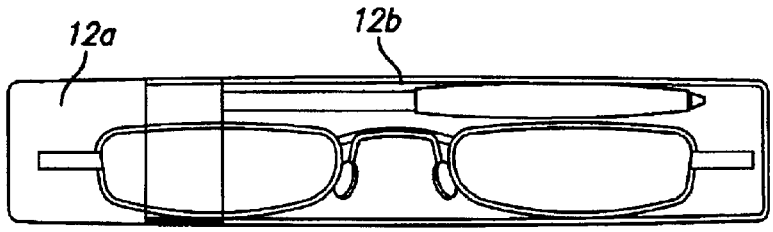
FIG. 5 is a side elevational view of another embodiment of an eyeglass case of the present invention.

In yet another embodiment the eyeglass container of the present invention is provided with a transparent region. As shown for case 12' in FIG. 1, and in FIGS. 2 and 5, the cases are provided with complete transparency. That is, FIGS. 2 and 5 show cases in which the first portion and the second portion are transparent, as the first portion 12*a* and the second portion 12*b* are transparent. FIGS. 3 and 4 show cases in which the second portion 12*b* is transparent and the first portion 12*a* is opaque, although the arrangement can be reversed. In a variation, an area of transparency may be provided on the first portion or second portion, providing a window through which the contents of the container may be viewed.

As shown in FIG. 2, the opening in the first portion 12*a* is sized to fit over the end 12*f* of the second portion 12*b* that exhibits the tapered cross section. This is a useful arrangement since it provides a place to store the first portion when it has been removed from its position over the opening of the second portion.

As shown in FIGS. 2, 3, and 5, the eyeglass case may be sized to hold another item, in this case, a writing instrument.

Figure 7:
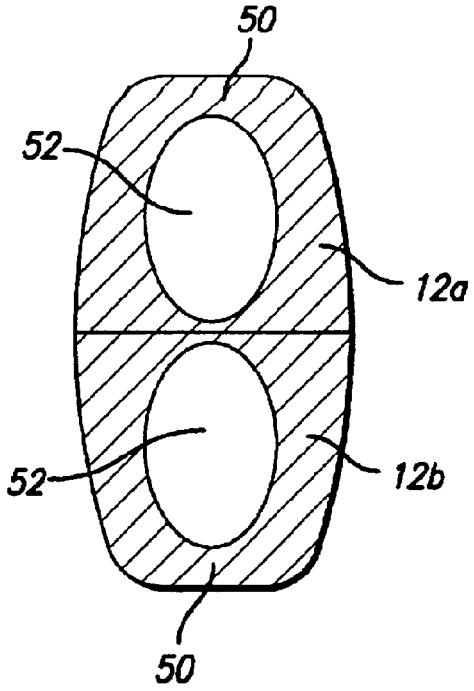
FIG. 7 is a perspective view of another embodiment of the present invention.
Figure 8:
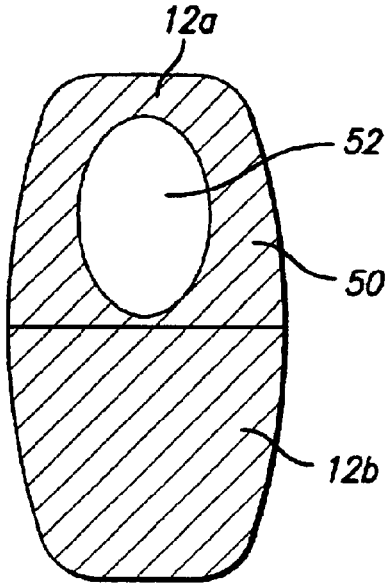
FIG. 8 is a perspective view of another embodiment of the present invention.

FIG. 7 shows an alternative embodiment in which the first portion 12*a* and second portion 12*b* are constructed of a first opaque material 50 that frames a second transparent material 52, which provides windows in the first and second portions. Alternatively, only one of the first portion and second portion can be constructed of a first opaque material 50 and second transparent material 52, so that only of the first portion and second portion are provided with a window. FIG. 8 shows an arrangement where the first portion 12*a* is provided with a window. Alternatively, the window can be provided on the second portion 12*b*.

We claim:

1. A system for displaying a plurality of eyeglasses, comprising:

(I) a plurality of eyeglass cases into which respective ones of the eyeglasses are received, each of which eyeglass cases comprising:

a first portion and a second portion, wherein when the first portion and the second portion are joined together they define an enclosed space into which the respective eyeglasses can be stored;

wherein the first portion includes a transparent portion;

wherein the first portion has an opening at a first end and a tapered cross sectional area at a closed end, such that the tapered cross sectional area of the first portion extends from a smaller cross sectional area at the closed end of the first portion to at least a point of a larger cross sectional area;

wherein the second portion has an opening at a first end and a tapered cross sectional area at a closed end, such that the tapered cross sectional area of the second portion extends from a smaller cross sectional area at the closed end of the second portion to at least a point of a larger cross sectional area; and wherein, when the case is in the open position, the tapered cross sectional area of one of the first portion and the second portion resides within the opening in the other portion; and (II) a display rack into which the plurality of eyeglass cases are received, the display rack comprising:

at least one shelf and support for the shelf;

wherein the shelf has a plurality of openings;

wherein, in order to display the contents of each eyeglass case when each case is closed by the first and second portions being joined together at the openings of the first and second portions, the closed end of the second portion of each case is placed in the opening in the shelf and comes to rest at the position of the tapered cross sectional area of the second portion of the case where the point of the larger cross sectional area at least equals the cross sectional area of the opening in the shelf; and wherein the transparent portion of the first portion of each eyeglass case is visible above the shelf holding the case when the closed end of the second portion of each case is placed in the opening in the shelf and comes to rest at the position of the tapered cross sectional area of the second portion of the case where the point of the larger cross sectional area at least equals the cross sectional area of the opening in the shelf.

2. The system of claim 1, wherein the first portion is essentially entirely transparent.

3. The system of claim 1, wherein the second portion includes a transparent portion.

4. The system of claim 1, wherein the second portion is essentially entirely transparent.

5. The system of claim 1, wherein the display rack includes at least a first shelf and a second shelf, wherein the first shelf and the second shelf are offset from one another vertically and the first shelf and the second shelf are offset from one another horizontally in a front-back direction.

* * * * *